US006093983A

United States Patent [19]

Singh

[11] Patent Number: 6,093,983

[45] Date of Patent: Jul. 25, 2000

[54] REMOTE CONTROL ADAPTER

[76] Inventor: Steven Sevak Singh, 17 Southdown Road, Brighton, Sussex, United Kingdom, BN1 6FH

[21] Appl. No.: 09/387,703

[22] Filed: Aug. 17, 1999

Related U.S. Application Data

[63] Continuation of application No. PCT/GB98/00473, Feb. 16, 1998.

[30] Foreign Application Priority Data

Feb. 17, 1997 [GB] United Kingdom ..... 9703248

[51] Int. Cl.[7] ..... H01H 47/00

[52] U.S. Cl. ..... 307/125; 307/116

[58] Field of Search ..... 315/294, 292, 315/295, 299, 312; 362/276, 226, 802; 307/125, 157, 116; 340/573

[56] References Cited

U.S. PATENT DOCUMENTS 3,893,019 7/1975 King ..... 323/19

4,237,386 12/1980 Instance ..... 307/116

5,895,985 4/1999 Fischer ..... 307/116

*Primary Examiner*—Fritz Fleming

*Assistant Examiner*—Robert L. DeBeradinis

*Attorney, Agent, or Firm*—Darby & Darby

[57] ABSTRACT

A remote control adapter (1) for connecting an electrical device (3) to an electrical supply (2) includes a remote control circuit (7) which is mounted on a substrate fitted within a housing (5) which forms part of the adapter body and which extends about a longitudinal axis of the adapter body so that the substrate is wrapped at least partly around the longitudinal axis. The remote control adapter (1) is provided for fitting in-line between an electrical power supply (2) and an electrical device (3) so that a number of functions of the device can be controlled or triggered remotely. The remote control circuit (7) is located within the adapter body (5) to minimise the overall size of the adapter, which is important for applications where the visual impact of the adapter is significant to the customer.

17 Claims, 7 Drawing Sheets

REMOTE CONTROL ADAPTER

This is a continuation of International Application No. PCT/GB-98/00473, filed Feb. 16, 1998, the entire disclosure of which is incorporated herein by reference.

FIELD OF THE INVENTION

The present invention relates to a remote control adapter and in particular one which is suitable for a light fitting.

SUMMARY OF THE INVENTION

According to the present invention, a remote control adapter for connecting an electrical device to an electrical supply, comprises:

an adapter body:

a first connector to connect the adapter body to the electrical supply;

a second connector to connect the adapter body to an electrical device; and, a remote control circuit responsive to a signal from a remote source, wherein the remote control circuit is mounted on a substrate fitted within a housing which forms part of the adapter body and which extends about a longitudinal axis of the adapter body so that the substrate is wrapped at least partially around the longitudinal axis.

In the present invention, a remote control adapter is provided for fitting in-line between an electrical power supply and an electrical device so that a number of functions of the device can be controlled or triggered remotely. The remote control circuit is located within the adapter body to minimise the overall size of the remote control adapter. This is particularity important for applications where the visual impact of the adapter is significant to the customer.

In one preferred embodiment of the present invention. the substrate is a flexible sheet. In another preferred embodiment, the substrate is an annular disc.

Preferably the remote source is a remote control transmitter. However, the remote source may be any form of external stimulus capable of being detected for example infra-red radiation from a human body.

In a preferred embodiment, the electrical device is a light bulb and the remote control circuit forms a dimmer switch. Preferably, the first connector is a fitting for a standard electrical bulb socket, i.e. a bayonet or a screw-type fitting. The second connector is adapted to receive a standard electrical fitting for a light bulb.

The remote control adapter may also be used with other electrical devices, for example, fans, smoke detectors and alarms. The remote control circuit may be designed to perform a number of control functions in addition to switching the device on and off. For example, the remote control circuit may include a timer circuit for controlling the length of time that the device is switched on or for implementing a delayed dimmer/off function. As a further example, the remote control circuit could be programmed to turn the light on gradually over a predetermined interval at a predetermined time.

Preferably, the remote control adapter is adapted to rotate to at least a limited extent about the longitudinal axis of the adapter body. More preferably, it is the second connector which is rotatable relative to the adapter body.

Preferably, the remote control circuit includes an infra-red receiver which is responsive to a signal from a remote control transmitter. The ability to rotate the adapter body makes it possible to select the position of a receiver of the remote control circuit. An additional element such as an infra-red detector for detecting the presence of a person within a predetermined area may also be provided in the adapter and be aligned accordingly.

BRIEF DESCRIPTION OF THE DRAWINGS

Examples of the present invention will now be described in detail with reference to the accompanying drawings, in which.

DETAILED DESCRIPTION

Figure 1:
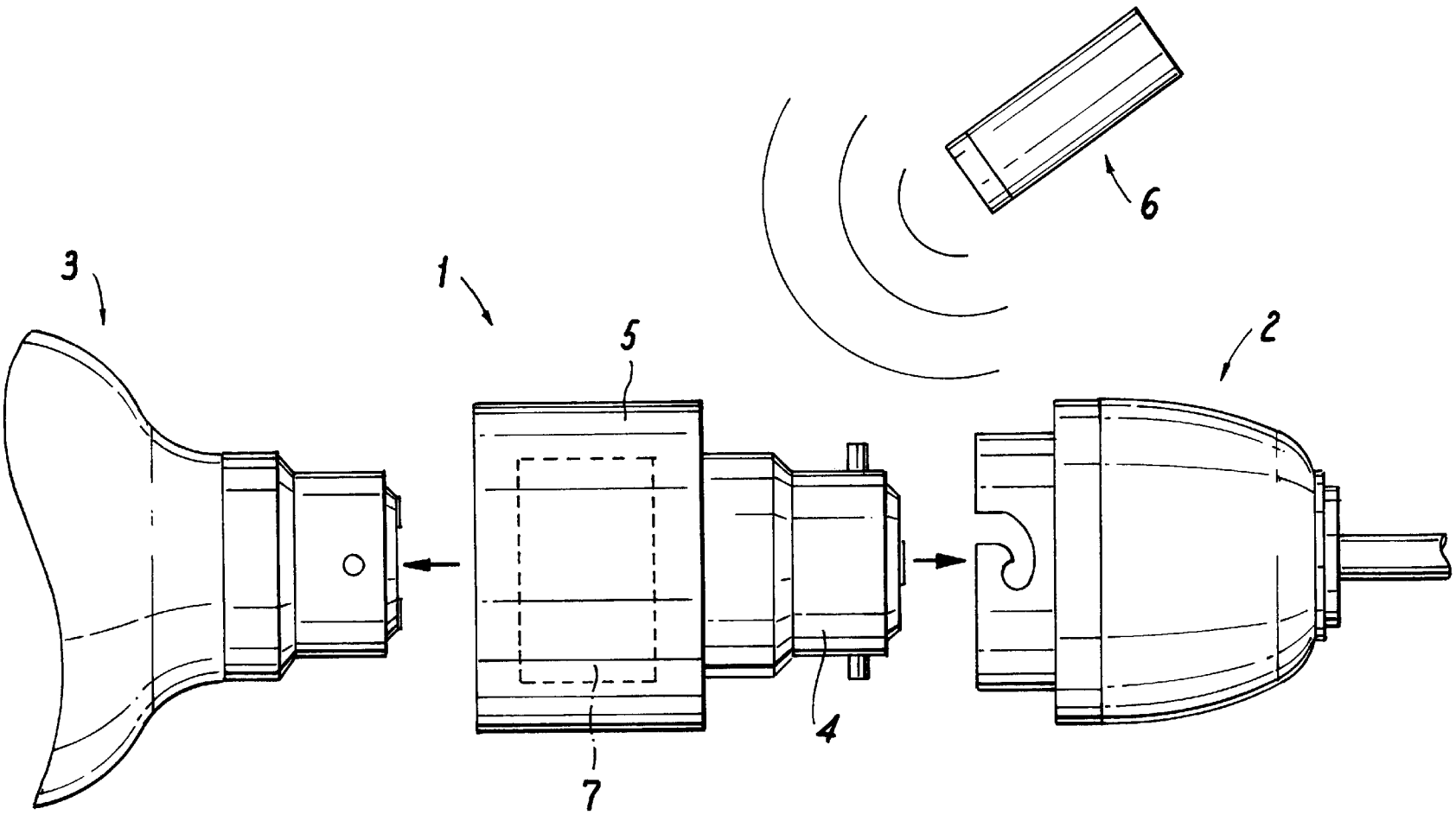
FIG. 1 shows schematically a remote control adapter in accordance with the present invention.

As shown in FIG. 1, a remote control adapter 1 for an electrical bulb socket 2 is provided in which the remote control adapter 1 is located between the electrical socket 2 and an electrical bulb 3. The remote control adapter 1 has a socket connector 4, in this case a bayonet fitting, and a complimentary bulb socket (bayonet) fitting (not shown) within an annular housing 5 for receiving the bayonet fitting of the bulb 3. As will be described below, the annular housing 5 is hollow and a remote control circuit 7 mounted on a flexible substrate or annular disc is located within the housing so that the circuit is effectively "wrapped" around the longitudinal axis of the adapter body. The remote control circuit 7 is operated by a remote transmitter 6 and may perform a variety of functions. The remote control adapter is moulded from a heat resistant thermoplastics material such as glass filled PET.

Figure 2:
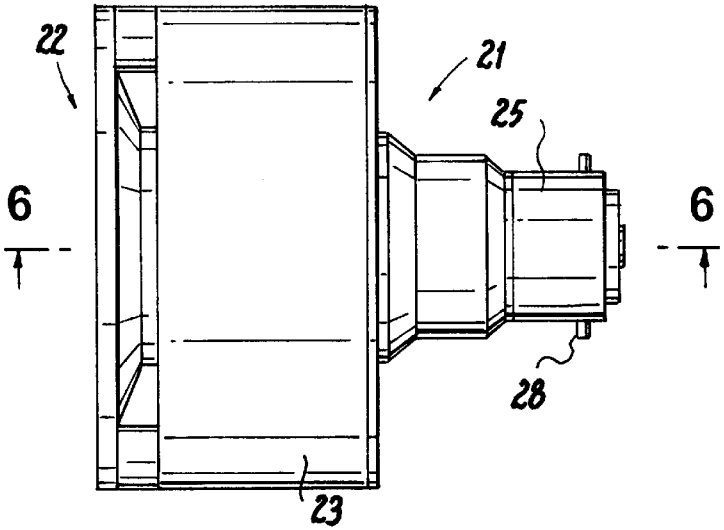
FIGS. 2 and 3 illustrate the assembly of a first example of a remote control adapter.
Figure 3:
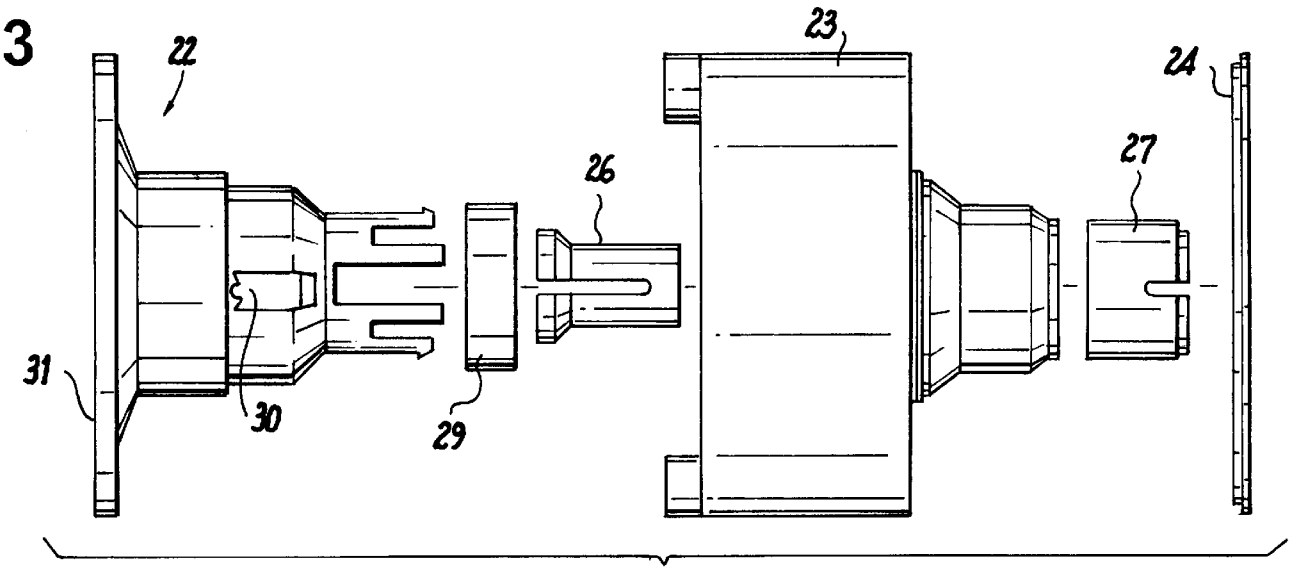

FIGS. 2 and 3 show the assembly of a first example of a remote control adapter 21. The remote control circuit has been omitted for clarity. The remote control adapter comprises an inner cup portion 22 which is received by an outer cup portion 23, an end plate 24, and a rotatable socket connector 25 consisting of a T-piece 26 and a socket cap 27 held together by a pin 28. An annular washer 29 is provided as a spring contact pressure washer, the function of which is described below. The inner cup portion 22 is moulded with an integral J-slot 30 to receive the bayonet fitting of an electrical bulb (not shown). The outer surface 31 of the inner cup portion 22 is provided with a reflecting material to reflect both heat and light away from the adapter body.

Figure 4A:
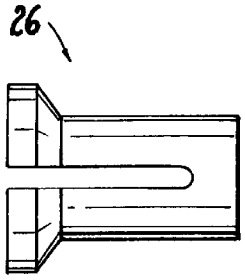
FIGS. 4A and 4B show a T-piece forming part of a socket connector.
Figure 4B:
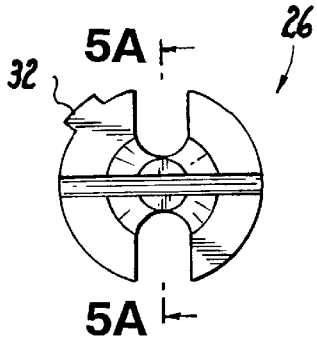
Figure 5A:
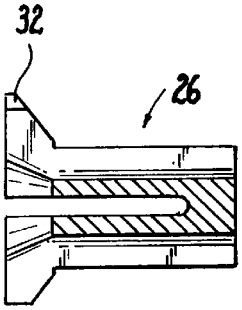
FIGS. 5A to 5G show views of the assembly of a rotatable socket connector of the remote control adapter.
Figure 5B:
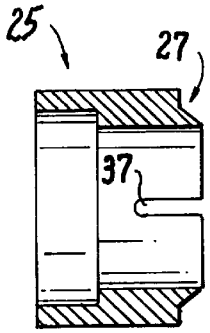
Figure 5C:
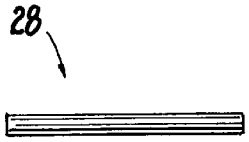
Figure 5D:
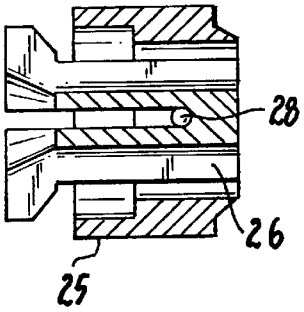
Figure 5E:
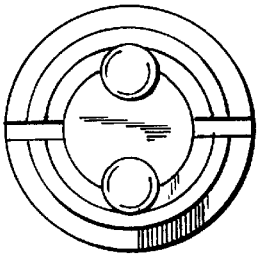
Figure 5F:
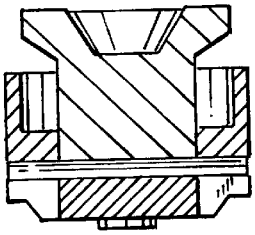
Figure 5G:
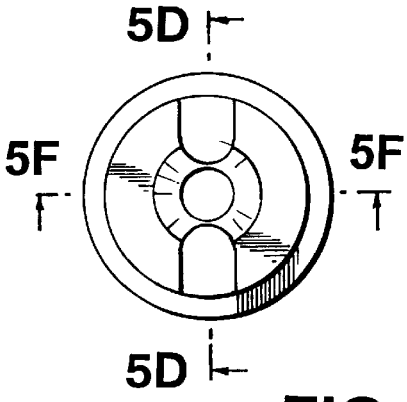

The T-piece 26 of the socket connector 25 is shown in FIGS. 4A and 4B and includes a key 32, the function of which is described below. The assembly of the socket connector 25 is shown in FIGS. 5A to 5G.

Figure 6:
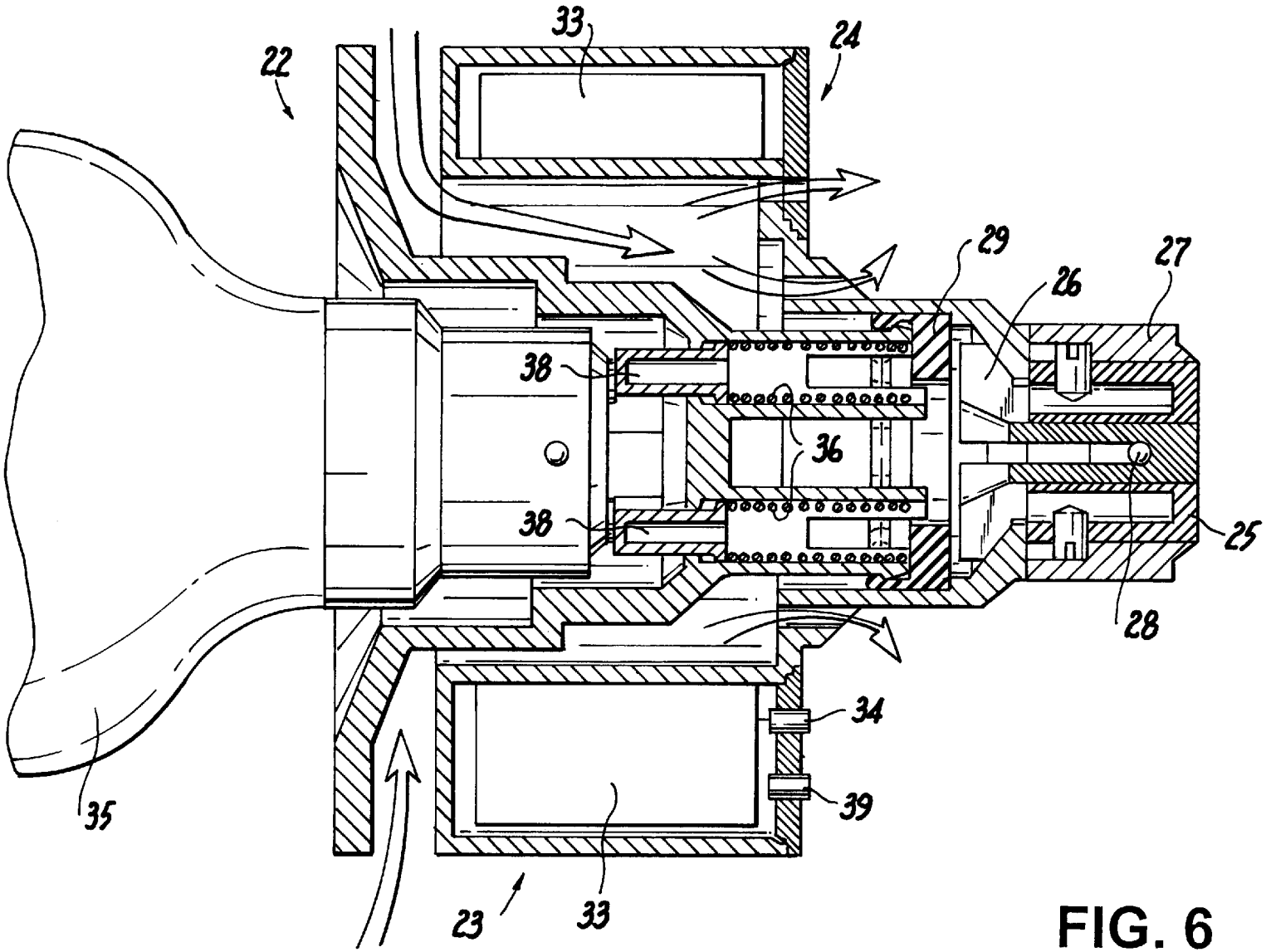
FIG. 6 shows a cross-sectional view of the assembled remote control adapter of FIG. 2, having a bulb fitted.

FIG. 6 shows a cross-sectional view of the remote control adapter 21. A remote control circuit 33 is fitted within the annular housing defined by the inner and outer cup portions.

Figure 7:
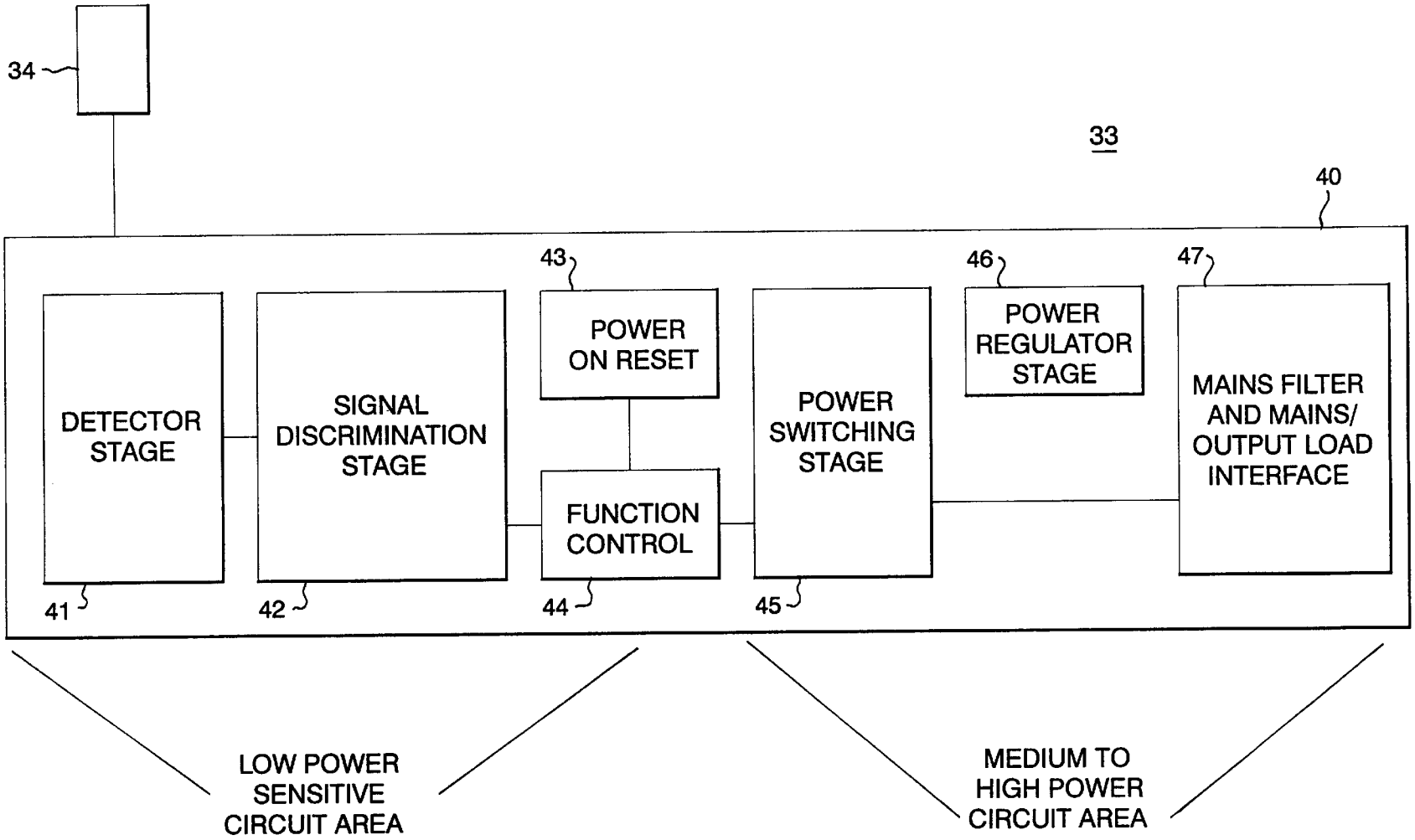
FIG. 7 shows schematically the layout of a remote control circuit mounted on a flexible substrate.

The remote control circuit 33 is mounted on a flexible substrate of the type used in the production of multi-layered printed circuit boards, for example, single sided copper FR4 PCB. so that it can be wrapped around the longitudinal axis with the annular housing the circuit is shown schematically in FIG. 7. An infrared receiver 34 is connected to the circuit and mounted so that it faces to the rear of the housing, i.e. in the shadow of the electrical bulb 35. The remote control circuit 33 receives power from the mains supply to the standard socket whenever the light is switched on. An electrical lead (not shown) is provided which connects the socket connector 25 to the circuit via an unbroken mid-lead spring-pinch electrical connection to one of the springs 36 of the bulb fitting. Additional electrical leads (not shown) connect the other spring 36 and the socket connector 25 to the remote control circuit 33. The annular washer 29 is fitted so as to retain the springs 36 within the inner cup portion 22 during assembly. Thereafter, it provides a pressure washer onto which the springs 36 bear so that the springs maintain good electrical contact with their respective electrical leads.

The remote control adapter 21 receives the bayonet fitting of the electrical bulb 35 well within the adapter to minimise the overall length of the adapter. As shown air is able to circulate through passages which extend through the core of the adapter body to help dissipate heat.

The socket connector 25 has the ability to rotate through a limited angle to adjust the relative location of the infra-red receiver. As shown in FIGS. 5A to 5G and 6, the socket connector 25 has a rotatable portion having a two part construction which is held together by a pin 28 which extends through a passage 37 in the socket connector 25. This pin 28 creates a bayonet fitting for locating in the electrical socket. The socket connector 25 is keyed for rotation about the longitudinal axis of the adapter, limited by a stop 32 coming up against a second stop (not shown) in the keyway provided. There is sufficient slack in the electrical leads for it within the outer cup portion 23 (not shown) connecting the socket connector 25 to the spring loaded plungers 38 of the bulb fitting within the adapter body and to the remote control circuit 33 so that they are able to twist to allow for this limited rotation. The ability to rotate means that where, for example, an infra-red detector 39 for detecting the presence of a person in a room is provided in the adapter body this infra-red detector can be aligned in a preferred direction.

FIG. 7 shows the layout of the remote control circuit 33. This circuit comprises surface mount components mounted on a flexible PCB substrate 40 so that the low power circuit elements are mounted towards one end of the substrate, with the high power components mounted at the other. This means that when the circuit is wrapped within the housing of the adapter body, low power circuit components are located well away from the high power circuit components, which might otherwise cause the adapter to malfunction. The detector stage 41 typically contains elements such as a signal sensor, an AGC (automatic gain control), a band pass filter, a demodulator, an integrator, a Schmitt trigger, and a drive stage. The signal discrimination stage 42 may contain a decoder, error check circuit or some other signal discriminating circuit function. For example, the signal discrimination stage 42 may be configured so that the circuit only reacts to a stream of pulses, thereby avoiding false activation due to random noise. The power-on-reset circuit 43 ensures that on power-up the mode of operation of the unit is defined. The function control stage 44 responds to a processed input signal and activates the power switching stage 45 accordingly. The power regulator stage 46 derives the necessary power rails required to support all the functional circuit blocks of the remote control circuit. The mains filter 47 limits both conducted and radiated electrical noise. The mains interface with the load and power switching is physically located away from the low power sensitive parts of the circuit for the reasons described above.

Figure 8:
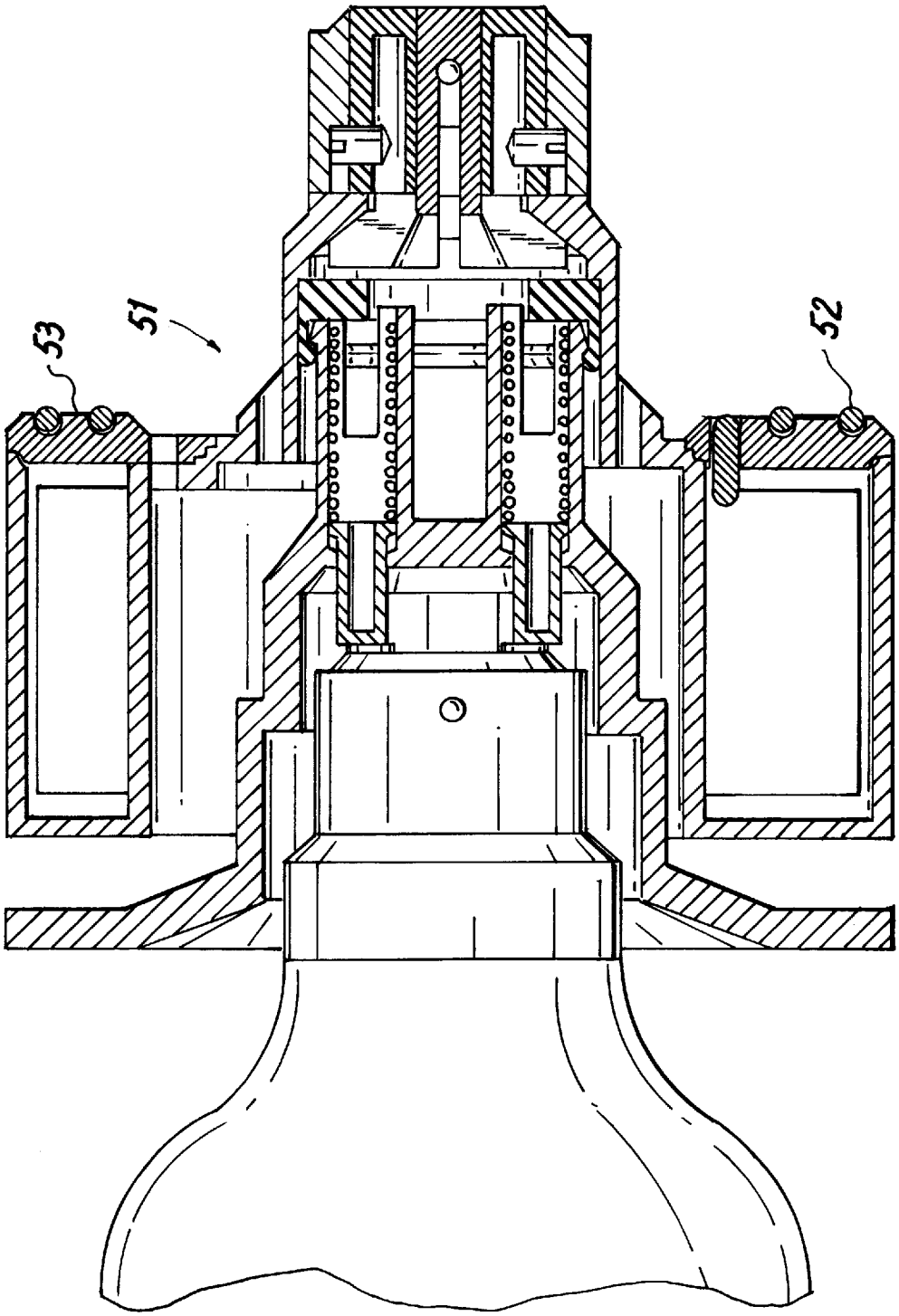
FIG. 8 shows a cross-sectional view of a second example of a remote control adapter; and, FIGS. 9A and 9B show an end plate for the remote control adapter of FIG. 8.
Figure 9A:
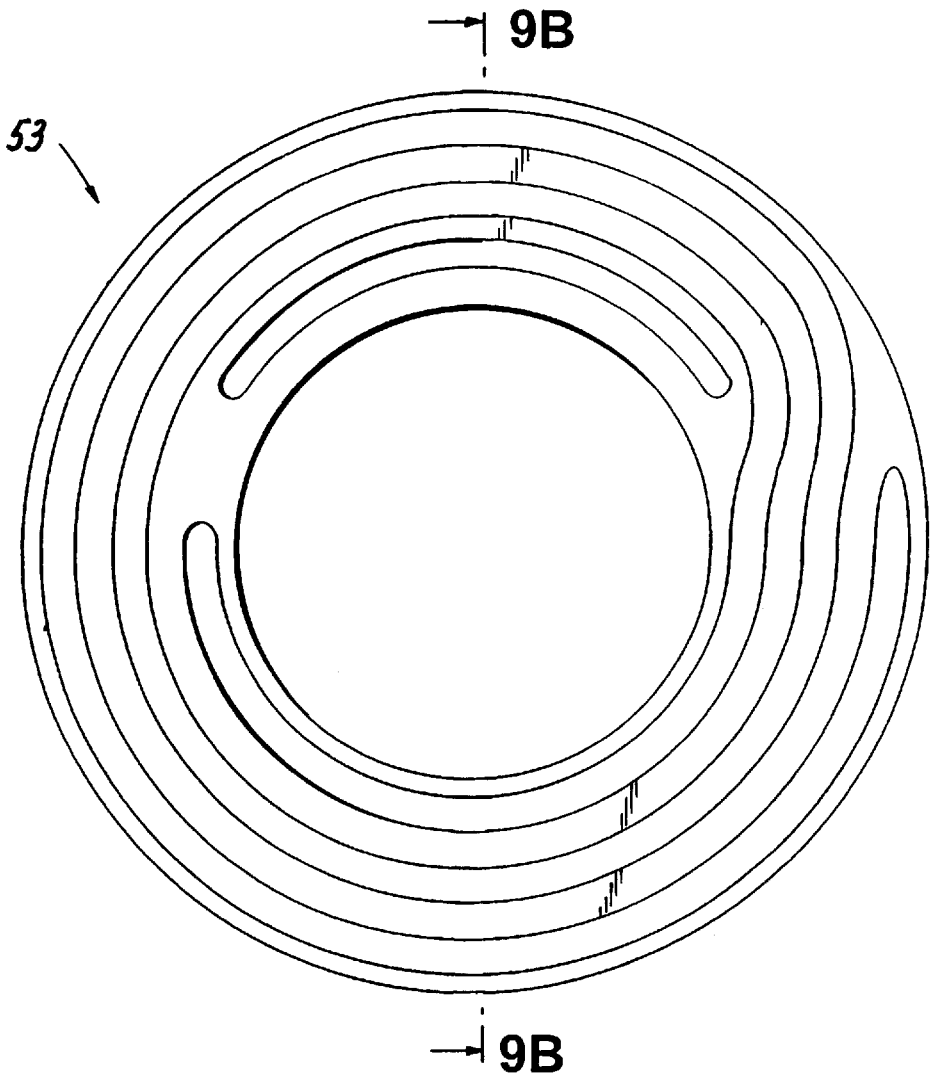
Figure 9B:
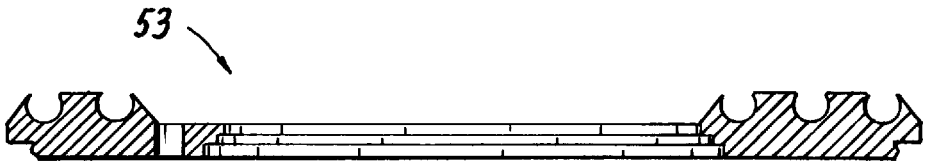

FIG. 8 shows a second example of a remote control adapter 51. In this example, the infra-red receiver is provided on the end of a sub-miniature cable 52 (DEF standard 61-12—Part IV, type 7-1-3A). The sub-miniature cable 52 serves as an extension cable to allow the infra-red receiver to be positioned away from objects such as light shades which may otherwise obstruct a signal from a remote control transmitter. The cable is wound around a specially adapted end plate 53, shown in detail in FIGS. 9A and 9B, which stores the cable and permits deployment of the required length of cable when necessary. Otherwise, the remote control adapter is the same as that described earlier with respect of FIGS. 1 to 7. As an alternative, the cable 52 may be a light pipe which couples light to an infra-red receiver within the adapter.

What is claimed is:

1. A remote control adapter for connecting an electrical device to an electrical supply comprising:

an adapter body;

a first connector (4) to connect the adapter body to the electrical supply;

a second connector to connect the adapter body to an electrical device; and, a remote control circuit (7, 33) responsive to a signal from a remote source, wherein the remote control circuit (7, 33) is mounted on a flexible planar substrate (40) Which is bent to fit within a housing (5) which forms part of the adapter body so that it is wrapped at least partially around the longitudinal axis of the adapter body.

2. A remote control adapter according to claim 1, further comprising a hollow core which communicates with vents at opposite ends of the adapter body to provide a passage for air to pass through the adapter body in the direction of the longitudinal axis to dissipate heat by convection.

3. A remote control adapter according to claim 2, in which the hollow core is bounded by the housing (5) of the adapter body.

4. A remote control adapter according to claim 1, in which the housing (5) is annular.

5. A remote control adapter according to claim 1, in which the remote source is a remote control transmitter (6).

6. A remote control adapter according to claim 1, in which the first connector (4) is a fitting for a standard electrical bulb socket and the second connector is adapted to receive a standard electrical fitting for a light bulb (3).

7. A remote control adapter according to claim 1, in which the remote control circuit (7, 33) includes a timer circuit adapted to control the length of time that the device is switched on.

8. A remote control adapter according to claim 1, in which the remote control circuit (7, 33) includes a timer circuit adapted to control length of time that the device is switched on for implementing a delayed dimmer/off function.

9. A remote control adapter according to claim 1, in which the remote control circuit (7, 33) is programmable to turn the light on gradually over a predetermined interval at a predetermined time.

10. A remote control adapter according to claim 1, which is adapted to rotate to at least a limited extent about the longitudinal axis of the adapter body.

11. A remote control adapter according to claim 10, in which the second connector is rotatable relative to the adapter body.

12. A remote control adapter according to claim 1, in which the remote control circuit (7, 33) includes a receiver which is responsive to a signal from a remote control transmitter (6).

13. A emote control adapter according to claim 12, in which the receiver is provided at one end of a length of extension cable (52).

14. A remote control adapter according to claim 13, in which the extension cable (52) is a light pipe.

15. A remote control adapter according to claim 12, in which the receiver is an infra-red receiver.

16. A remote control adapter acording to claim 13, in which the adapter body includes an end plate (53) which is adapted to store the extension cable (52) and permit deployment of a required length of cable.

17. A remote control adapter according to claim 1, comprising an infra-red detector for detecting the presence of a person within a predetermined area.

* * * * *